US007674158B2

(12) United States Patent
Crocker

(10) Patent No.: US 7,674,158 B2
(45) Date of Patent: Mar. 9, 2010

(54) COMBINED GRINDER AND WATER BLASTER FOR STRIPE REMOVAL SYSTEM

(76) Inventor: James P. Crocker, 1305 SE. Salerno Rd., Stuart, FL (US) 34997

( * ) Notice: Subject to any disclaimer, the term of this patent is extended or adjusted under 35 U.S.C. 154(b) by 35 days.

(21) Appl. No.: 11/368,035

(22) Filed: Mar. 3, 2006

(65) Prior Publication Data

US 2007/0207711 A1 Sep. 6, 2007

(51) Int. Cl.
*B24B 23/02* (2006.01)
*B24B 7/22* (2006.01)

(52) U.S. Cl. ..... 451/73; 451/352; 299/39.4

(58) Field of Classification Search ..... 451/352, 451/73, 65; 125/38; 299/39.4, 39.2, 39.1
See application file for complete search history.

(56) References Cited

U.S. PATENT DOCUMENTS 3,043,200 A * 7/1962 Huttash ..... 134/17
3,407,005 A * 10/1968 Simms et al. ..... 299/39.6
3,619,632 A 11/1971 Labombarde
3,658,589 A 4/1972 Shaddock
3,694,033 A * 9/1972 Rowley et al. ..... 299/39.4
3,812,379 A 5/1974 Kaufman et al.
3,900,969 A 8/1975 Diehn
3,929,377 A * 12/1975 Weaver et al. ..... 299/1.5
3,977,128 A 8/1976 Goff
4,199,837 A 4/1980 Fisco, Jr.
4,227,893 A 10/1980 Shaddock
4,336,671 A 6/1982 Nelson
4,376,358 A 3/1983 Shelton
4,377,924 A 3/1983 Bergh
4,509,963 A 4/1985 Jackson
4,578,840 A 4/1986 Pausch
4,683,684 A * 8/1987 Yie ..... 451/92
4,753,052 A 6/1988 Dickson
4,793,734 A * 12/1988 Shook et al. ..... 404/90
4,854,770 A * 8/1989 Puchala et al. ..... 404/75
4,935,984 A 6/1990 Bryant et al.
5,002,595 A 3/1991 Kehr
5,108,471 A 4/1992 Poborsky
5,236,278 A 8/1993 Dickson
5,605,381 A * 2/1997 Schmoock et al. ..... 299/39.2
5,772,497 A * 6/1998 Dummermuth ..... 451/350
5,826,460 A 10/1998 Soncina et al.
6,393,944 B1 5/2002 Soncina et al.

* cited by examiner

*Primary Examiner*—Robert Rose
(74) *Attorney, Agent, or Firm*—McHale & Slavin, P.A.

(57) ABSTRACT

A self-propelled mobile marking removal system which comprises a mobile vehicle assembly including a chassis, a high pressure liquid pump in fluid connection with a liquid reservoir contained within said chassis, said high pressure liquid pump is further in fluid connection with a blast head, said blast head having at least one high pressure nozzle for delivering liquid at high pressure to a marked surface, a waste removal hose fluidly coupled with said blast head and a sump for collection of liquid and debris, said blast head positionable along a left or a right side of said chassis, a mechanical abrasion means, said mechanical abrasion means positionable along a left or a right side of said chassis in front of said blast head, said mechanical abrasion means is constructed and arranged to substantially remove marking material protruding above said marked surface and said blast head constructed and arranged to substantially remove any marking material extending below said marked surface. As a result of this arrangement the self-propelled vehicle can travel at speeds up to approximately 25 MPH.

20 Claims, 7 Drawing Sheets

COMBINED GRINDER AND WATER BLASTER FOR STRIPE REMOVAL SYSTEM

RELATED APPLICATIONS

This application is related to application Ser. No. 10/884,643, filed Jul. 2, 2004, entitled "Stripe Removal System"; Ser. No. 11/340,104, filed Jan. 26, 2006, entitled "Mobile Mark Removal System"; Ser. No. 11/340,738, filed Jan. 26, 2006, entitled "Transportable Holding Tank For Stripe Removal system" and U.S. patent application filed Mar. 3, 2006, U.S. Express Mail No. EV531127420US, entitled "Articuable Arm for Mark Removal System" the contents of which are herein incorporated by reference.

FIELD OF THE INVENTION

This invention relates to the field of high pressure water cleaning devices for highways, runways, parking decks, and other hard surfaces.

PRIOR ART BACKGROUND

The use of paint stripes on road surfaces is the accepted method to indicate vehicle lanes, crossing lanes, parking areas and numerous other indicators. Various pavement marking techniques are well known in the art, including the use of traffic paint, thermoplastics, epoxy paints and preformed tapes. Most pavement marking systems are intended to be as durable and permanent as possible, and resistant to weathering and wear from traffic. Common road surfaces are asphalt and concrete. The removal of such striping is typically required when the road is to be resurfaced or if the indication is to be changed.

When polymers such as paint or plastic are used for roadway marking, the surface of the pavement is penetrated from ⅛-⅜ inch, so that mere surface removal of the marking material is not sufficient to remove the marking. Therefore, current pavement marking removal machines often employ various forms of cutting devices to remove the marking material, as well as a portion of the underlying layer of pavement material in order to effectively remove painted lines.

Commonly known methods for removal of such markings typically include the use of abrasive grinding wheels, material removing cutters, or blasting of abrasive particles against the material to be removed. However, the use of these devices often results in undesirable grooves in the pavement surface.

For example, one type of cutting machine is disclosed in U.S. Pat. No. 5,236,278 known as "Road Pro" manufactured by Dickson Industries, Inc. This type of machine employs parallel passive shafts that extend between circular rotating end plates. Hardened steel star wheels are carried on the parallel passive shafts and these star wheels strike and abrade the pavement surface. While this type of device is effective for removal of markings, it often creates excessive heat which may melt thermoplastic materials causing equipment to gum up. Also, since markings may sometimes penetrate below the surface of the roadway, as in the case of an asphalt roadway, a portion of the pavement surface must be removed to remove the marking. This results in excessive debris, slower operating speeds and a grooved surface that must be repaired. The instant invention avoids these problems by employing a combination abrader and high pressure fluid nozzle to remove the markings without penetration of the surface of the roadway.

Another approach to pavement marking removal is the use of diamond saw blades or cutters arranged to make a dado cut. Still other types of machines use grinders or shot blast as described in U.S. Pat. Nos. 4,753,052; 4,376,358; 3,900,969; 4,336,671; 3,977,128 and 4,377,924. Unfortunately, these devices must remove a portion of the pavement material to effectively remove the marking, thereby leaving unsightly and potentially dangerous grooves in the pavement. They also generate a large amount of abraded dust and particulate matter from the road surface which is either dispersed into the air or remains along the road surface requiring further cleaning. The instant invention overcomes these problems by capturing all the dust and debris that is generated by the strip removal process. Since the invention removes the final amount of striping with high pressure liquid, there is no damage to the surface of the roadway.

It is also known in the prior art to utilize high-pressure water jets to remove markings from pavements. The instant inventor teaches a Stripe Removal Systems in U.S. patent application Ser. Nos. 10/884,643; 11/340,104 and 11/340,738, the contents of which are incorporated herein in their entirety. In addition, NLB Corporation markets a high pressure water jet system for removing paint from pavement under the name "STARJET". BLASTERS Corporation markets a high pressure water device which is mounted on a truck similar to the STARJET device.

The most common problem associated with these prior art devices is the removal of a portion of the pavement material during removal of the markings. If the entire road surface was going to be paved afterwards, this would not present a problem. However, if the road surface or parking lot was not going to be subsequently paved these prior art systems would leave unsightly and potentially dangerous grooves in the road surface or pavement which would have to be repaired prior to its being open to traffic. This repair involves a timely and costly filling in of the grooves.

The use of high powered water jet systems to remove striping or paint from a roadway surface or parking lot overcomes the problem of abrading away the top layer of the roadway surface and leaving grooves. These systems use a very large amount of water to remove the striping. This water cannot be dumped along the road side and must be properly disposed of. This presents multiple problems. The downtime to send the contaminated water off for disposal and the cost of proper disposal. Also, these systems do not move very fast. They operate at approximately 7,000 ft per hour.

Therefore, what is needed in the art is a stripe removal system that is capable of efficiently removing striping and other markings without damage to the underlying surface. The system should remove the striping without damaging the underlying surface in the event that new striping is to be subsequently applied. Also, what is needed is a system which will not contaminate the environment by allowing abraded dust and particulate mater from the roadway to be released into the atmosphere or surroundings. In addition, the system should be capable of employing water to remove the striping efficiently without excessive disposal costs or downtime. Finally, the system should be capable of removing striping at surface speeds far in excess of those currently available.

SUMMARY OF THE INVENTION

Disclosed is a cleaning system for removing coatings from a surface by a combination of abrading and high pressure liquid. Striping and markings on roadways normally comprise paints or thermoplastics. These markings normally extend approximately ¼ inch above the surface and approximately ¼ inch below the surface. Surface removal of the striping and markings is not sufficient to completely remove them. The marking removal system of the instant invention employs a combination of an abrading device and high pressure liquid to remove the markings without damage to the underlying surface. The prior art devices have relied on high pressure liquids to remove the markings above and below the surface. One of the problems with these systems is that the rate of marking removal is very slow. The instant invention overcomes this problem by employing an abrading device to remove the markings above the surface and high pressure liquid to remove the markings below the surface. The abrading device removes the markings above the surface at a substantially greater rate than high pressure liquids can. This leaves the markings below the surface for the high pressure liquids to remove. Since the high pressure liquids only have to remove the markings below the surface they can accomplish this at a substantially greater rate than having to remove the markings both above and below the surface. As a result the instant invention can remove markings on a surface at a substantially greater rate than the prior art devices.

Accordingly, it is an objective of the instant invention to provide a marking removal system which employs both an abrading device and a high pressure liquid device to remove the markings.

It is a further objective of the instant invention to provide a marking removal system which permits rapid and efficient removal of markings at a substantially greater rate than prior art devices.

It is yet another objective of the instant invention to provide a marking removal system mounted on a single mobile vehicle which can operate at speeds substantially greater than prior art vehicles, up to approximately 25 MPH.

It is a still further objective of the invention to provide a marking removal system which operates a high pressure water pump, a vacuum pump, a hydraulic pump and an infinitely variable speed hydrostatic drive from a single prime mover.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

BRIEF DESCRIPTION OF THE FIGURES

While the novel features of the invention are set forth with particularity in the appended claims, the invention, both as to organization and content, will be better understood and appreciated from the following detailed description, taken in conjunction with the drawings, in which:

DETAILED DESCRIPTION OF THE INVENTION

While the present invention is susceptible of embodiment in various forms, there is shown in the accompanying drawings and will hereinafter be described a presently preferred embodiment with the understanding that the present disclosure is to be considered an exemplification of the invention and is not intended to limit the invention to the specific embodiments illustrated.

Figure 1:
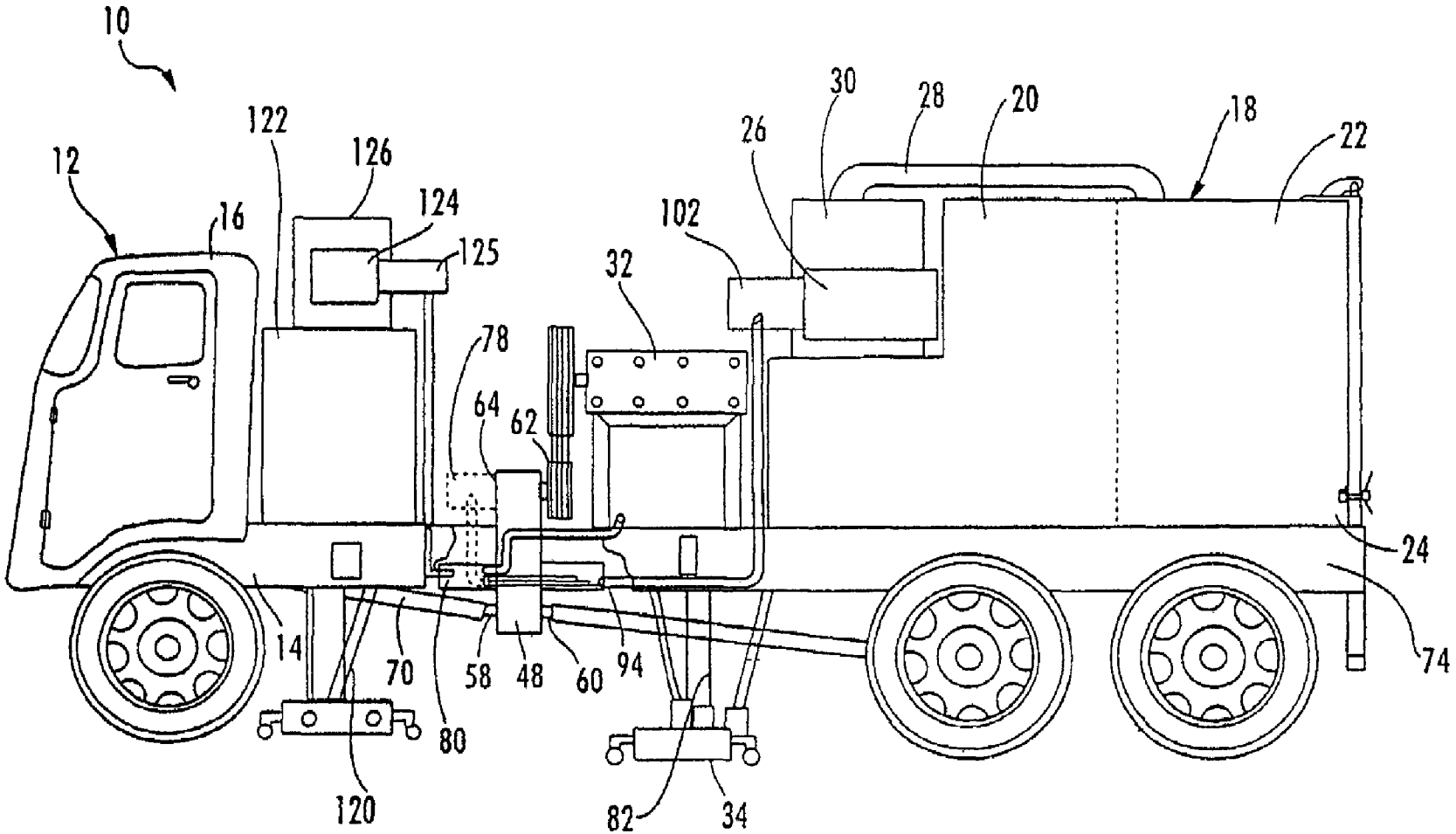
FIG. 1 is a side view, partially in section, of one embodiment of the instant invention with the blast head and abrasion means in the operational position.
Figure 2:
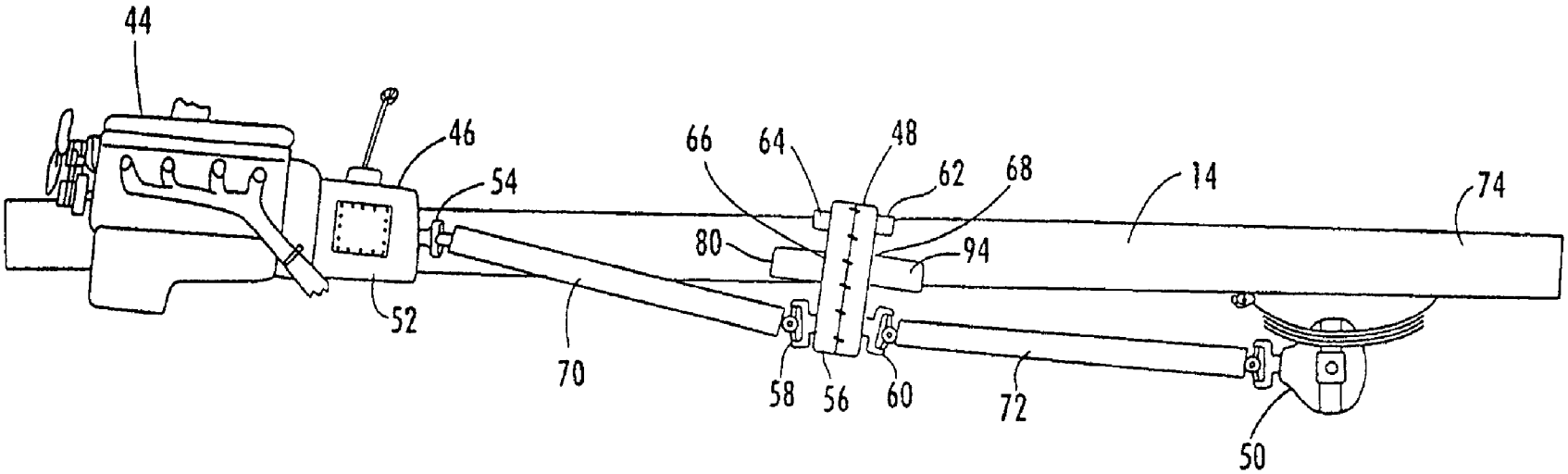
FIG. 2 is a partial side view of the prime mover and the drive line of one embodiment of the instant invention.

The marking removal system 10, shown in FIG. 1, includes a prime-mover vehicle 12, preferably a truck, which has an elongated frame or chassis 14. Mounted on a front portion of the elongated chassis 14 is a cab 16 for enclosing the operator as well as the driving and operating controls. Mounted on a front portion of the chassis is a prime mover 44 (FIG. 2). The prime mover is generally an internal combustion engine of a type well known in the art, utilizing diesel, gasoline, propane, natural gas or other suitable fuels.

Referring to FIG. 2, the prime mover 44 is connected to the truck drive-train which includes a first transmission 46 and a second transmission 48 as well as the drive axle gears 50. The first transmission is operatively coupled to the prime mover as is well known in the art. The first transmission is preferably a manual type transmission with multiple forward and reverse gears such as is well known in the art. Alternatively, an automatic transmission having at least one forward and one reverse gear may be utilized without departing from the scope of the invention. The first transmission includes a case 52 and an output shaft 54.

The second transmission 48 is secured to the chassis of the truck between the output shaft of the first transmission 46 and the drive axle 50. The second transmission includes a case 56, a first input shaft 58, a first output shaft 60, a second output shaft 62, a third output shaft 64, a hydraulic pump output 66, and a hydraulic motor input 68. In the first preferred embodiment, the first input shaft 58 and the first output shaft 60 are axially aligned to extend from both sides of the case 56. Also, within the preferred embodiment, the second and third output shafts 62, 64 are axially aligned to extend from both sides of the case 56 and are spaced above the first input and output shafts as illustrated in FIG. 2. Alternatively, the second and third output shafts 62, 64 may be parallel with respect to one another and spaced in a horizontal plane to be above or below the first input and output shafts respectively. The hydraulic pump output 66 and hydraulic motor input 68 are preferably positioned along the outer surface of the case 56 between the axis of the second and third outputs and axis of the first input and output. However, it should be noted that other positions suitable for mounting the hydraulic pump and motor may be utilized without departing from the scope of the invention. Transmissions such as the second transmission described above are available from suppliers such as Omsi Transmission of Volciano Italy and are disclosed in U.S. Pat. Nos. 5,826,460 and 6,393,944, the contents of which are incorporated herein by reference.

A first drive shaft 70 is connected to the output 54 of the first transmission 46 and the first input 58 of the second transmission 48. A second drive shaft 72 is coupled between the output shaft 60 of the second transmission 48 and the drive axle 50 of the truck.

Referring to FIGS. 1-4, mounted on a rear portion 74 of the chassis is a holding tank 18, including a water tank portion 20 and a vacuum recovery tank portion or sump 22. In one embodiment the rear portion 24 of the holding tank is pivotally mounted on the truck chassis 14 and hydraulicly powered to tilt in the vertical plane to permit dumping of the contents of the vacuum recovery tank or sump. The recovery tank 22 is operably connected to a vacuum pump 26 by a suitably sized conduit 28. The vacuum pump is preferably capable of drawing approximately 1100 CFM (cubic feet per minute) of air through the vacuum tank. Operably connected between the vacuum tank and the vacuum pump is a dust separator 30. The dust separator is constructed and arranged to prevent airborne particles drawn through the vacuum tank from being drawn through the vacuum pump and discharged into the atmosphere.

Figure 3:
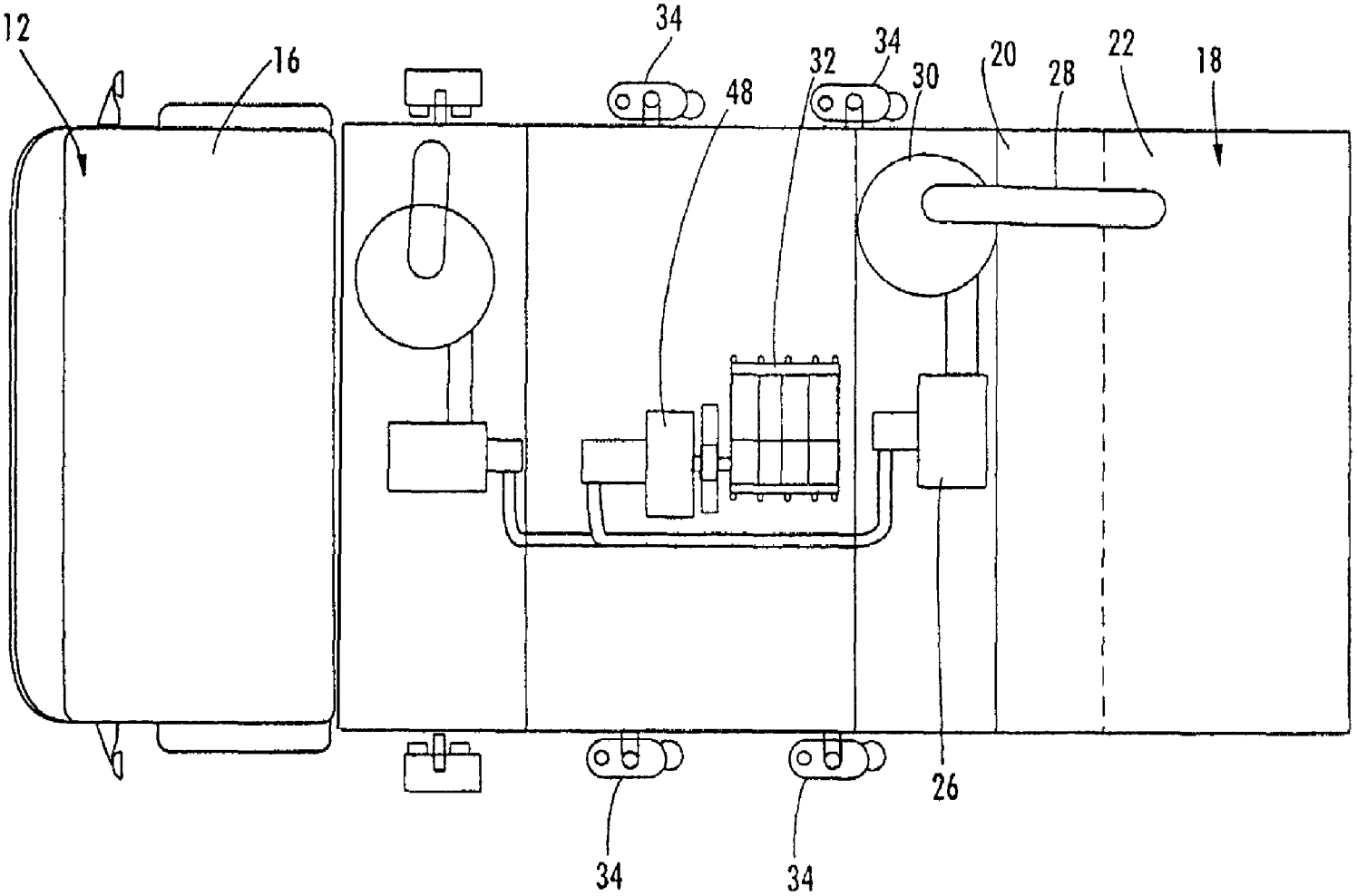
FIG. 3 is a top view of the embodiment illustrated in FIG. 1 illustrating the positions of the blast heads and abrading devices.

Also mounted on the chassis is a high-pressure water pump 32. The high-pressure water pump is capable of supplying 2-15 GPM (gallons per minute) of water to at least one spray head 34 at 25,000-45,000 PSI (pounds per square inch). In a most preferred embodiment, the high pressure water pump is constructed and arranged to deliver 6 GPM to each of the rotating spray heads at about 40,000 PSI. A high pressure hose or conduit is used to connect the high-pressure water pump with the spray head(s). A single spray head 34 may be mounted on one side of the truck as shown in FIG. 1 or multiple spray heads may be mounted on one side of the truck as shown in FIG. 3. In addition, the spray heads 34 may be mounted on both sides of the truck to provide for a doubling of the treatment area at a given speed of the truck.

Figure 4:
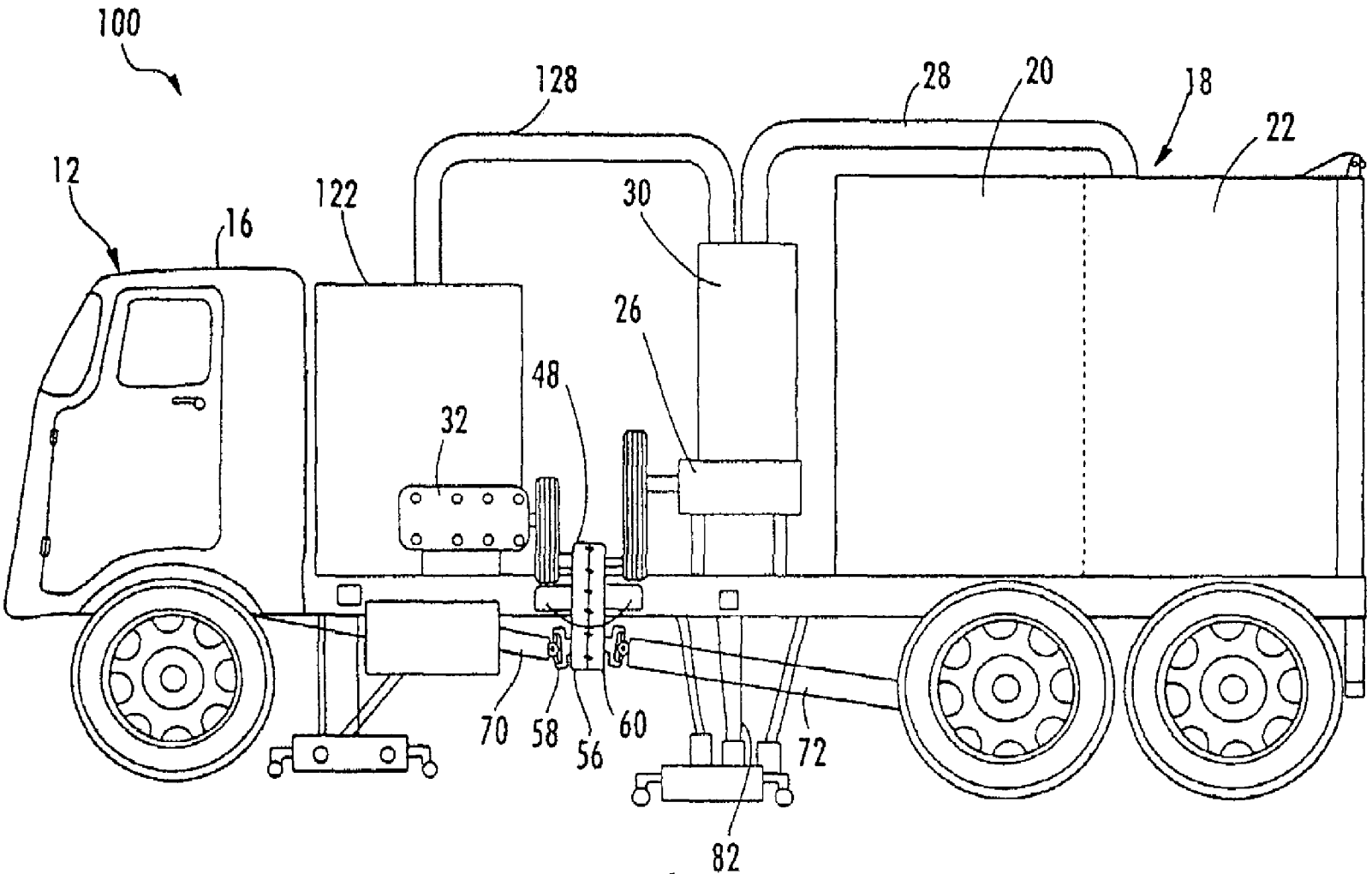
FIG. 4 is a side view of an embodiment of the invention with the blast head and abrading device in their operational positions.
Figure 6:
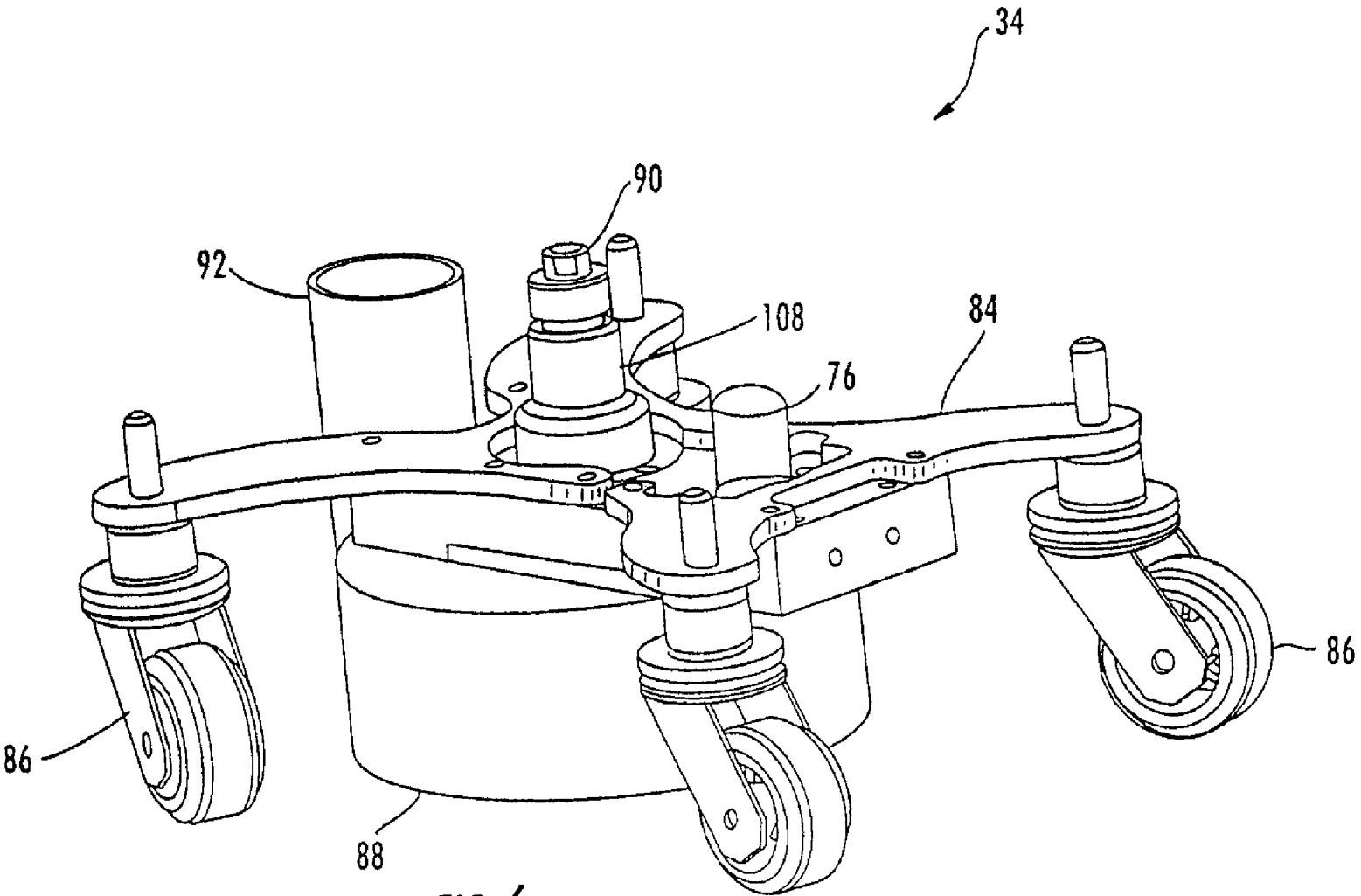
FIG. 6 is a perspective view of a spray or blast head.

A spray head or blast head 34 will now be described with reference to FIG. 6. A plurality of high pressure nozzles (not shown) are rotatably secured within the spray head 34 along an elongated tubular member (not shown). Rotation of the elongated tubular member is controlled via a hydraulic motor 76. Hydraulic pump 78 and/or 80 supply hydraulic fluid to the hydraulic motor 76 via high pressure hose 82 (FIGS. 1 and 4). Hydraulic motor 76 is coupled to a rotary shaft (not shown) mounted in housing 108 and the elongated tubular members are mounted on the rotary shaft. By controlling the pressure and flow of the hydraulic fluid the speed of rotation of the tubular members can be controlled. A control device (not shown) is provided in the cab 16 of the truck to allow an operator to vary the speed of the rotating tubular members. The spray or blast head is carried on a chassis 84 supported on casters 86. A shroud 88 descends from the chassis and surrounds the high pressure nozzles. The spray head is connected to the high pressure fluid pump by high pressure hose 90 and the shroud 88 is connected to the vacuum tank by a vacuum hose 92. The spray or blast head has to remove only the markings below the surface of the road or area to be cleaned as a result of the abrading device, the operation of which will be explained below. Therefore the rate of removal of the markings is substantially increased and the rate that the truck can move down the road is substantially increased.

Figure 7:
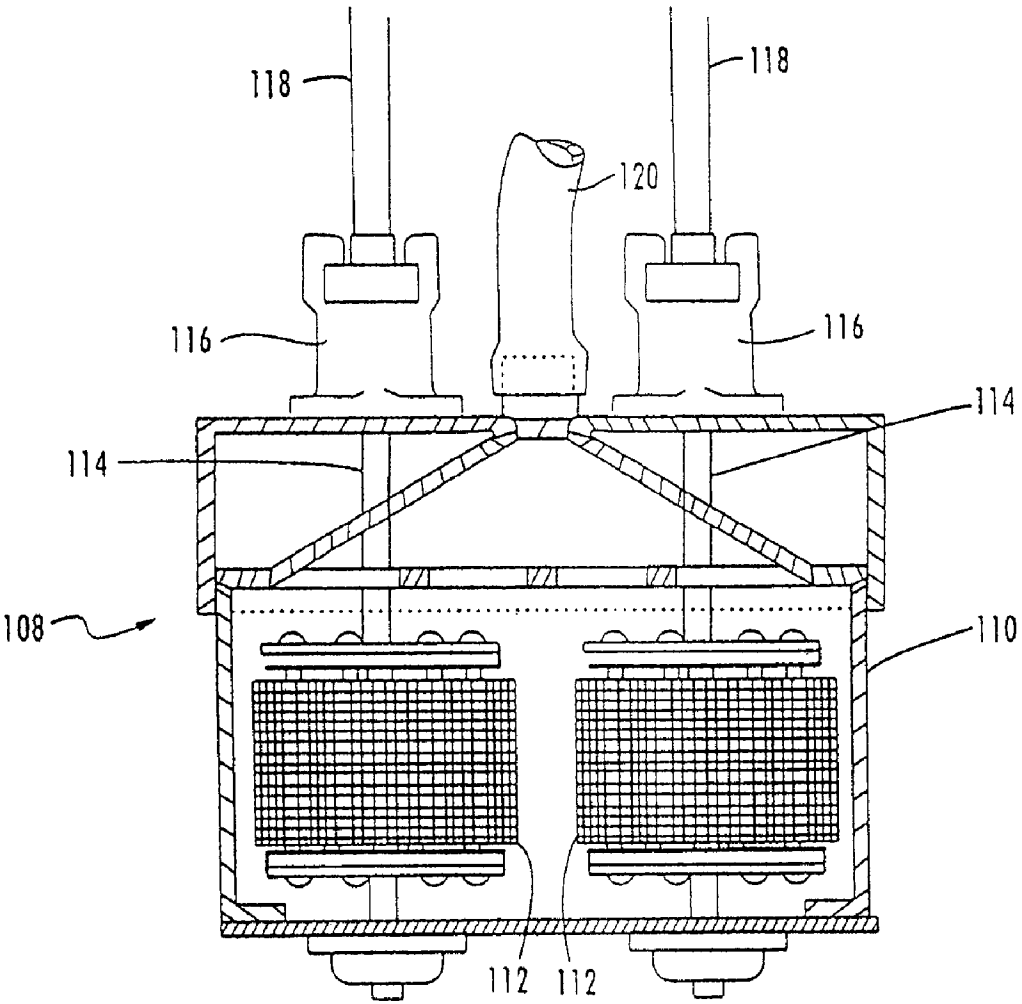
FIG. 7 is a top sectional view of a abrading device.

The abrading device 108 will now be described with reference to FIG. 7. A substantially rectangular housing 110 surrounds a pair of cylindrical grinders 112. Each cylindrical grinder is mounted on a rotary axle 114 which is mounted by bearings or other suitable means (not shown) in side portions of the housing. A hydraulic motor 116 is connected to each rotary axle at one end thereof and drives the axle. The hydraulic motor 116 is connected to hydraulic pump 78 and/or 80 via high pressure hose 118 and controlled from the cab of the truck. A vacuum hose 120 connects the housing to a debris collection tank 122. The markings and other debris removed by the abrading device are drawn into the debris collection tank via the vacuum pump 124. Vacuum pump 124 is driven by hydraulic motor 125. The debris is separated from the air in the debris collection tank. Operably connected between the outlet of the debris collection tank and the vacuum pump 124 is a dust separator 126. The dust separator is constructed and arranged to prevent airborne particles from being drawn through the vacuum pump and discharged into the atmosphere. Vacuum pump 124 is similar in size and construction to vacuum pump 26. While two cylindrical grinders are illustrated in a preferred embodiment, a single cylindrical grinder can also be employed in each abrading device 108. Since the abrading device removes the markings above the surface of roadway, without having to remove the markings below the surface, the rate of removal is substantially increased and therefore the truck can move substantially faster down the road or surface to be cleaned. Alternatively, the abrading device does not have to be provided with a debris collection device. The debris can be collected by the collection device of the blast heads which follow behind the abrading device.

In an alternative embodiment, illustrated in FIG. 4, a single vacuum pump 26 is connected to both vacuum recover tank 22 and debris collection 122. Dust separator 30 is operably connected between to both tanks via conduits 28 and 128 and the vacuum pump 26. In this embodiment both manufacturing costs and equipment weight are saved through the use of a single vacuum pump and a single dust collector.

Figure 5:
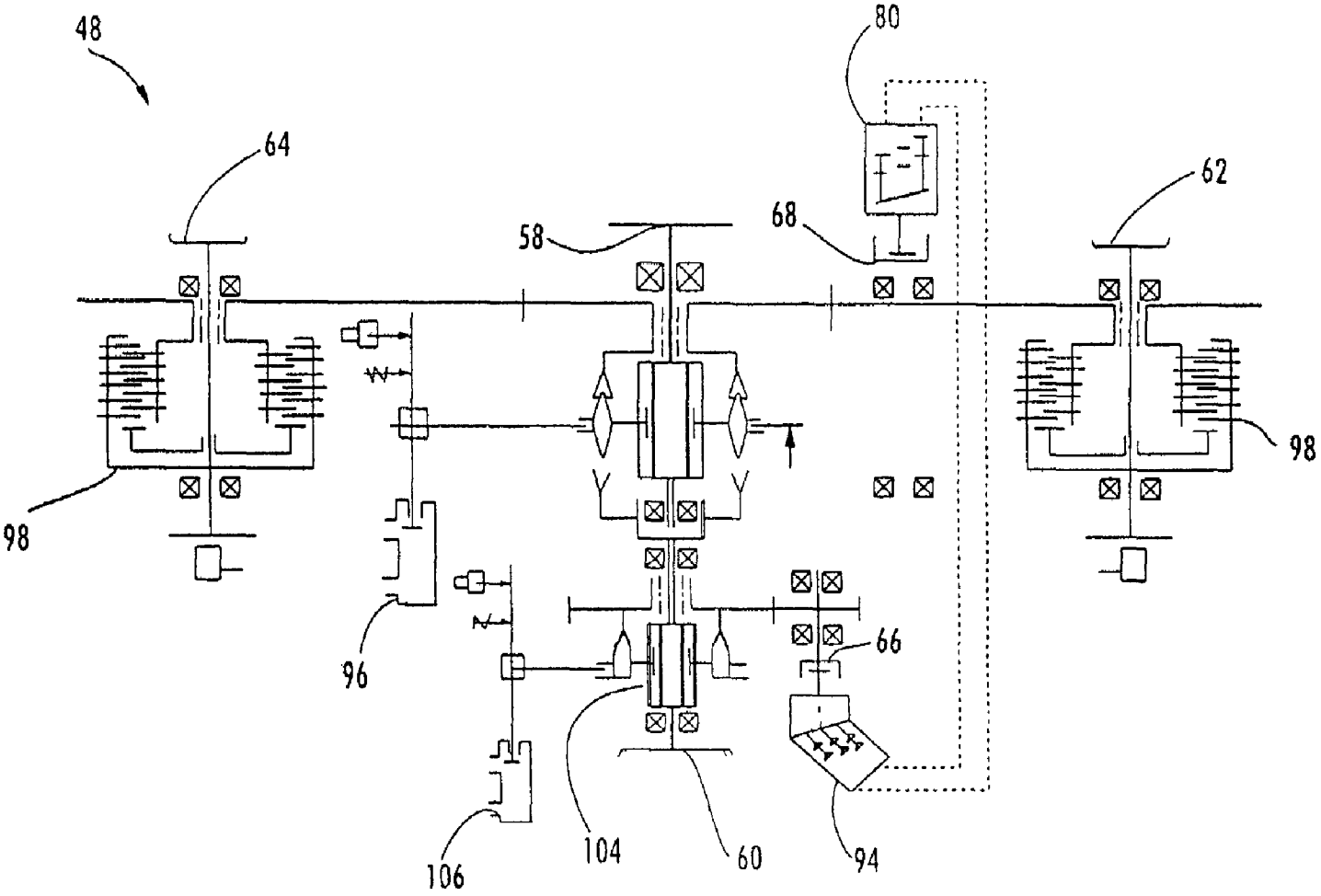
FIG. 5 is a schematic illustration of the second transmission of the instant invention.

Referring to FIG. 5, a schematic representation of one embodiment of the second transmission 48 is illustrated. The construction of the second transmission 48 provides the marking removal truck with two modes of operation, a transport mode and a work mode. In the transport mode the first input shaft 58 of the second transmission is operatively coupled to the output shaft 60. The engagement between the shafts may be accomplished utilizing splined shafts and a ring having internal splines or other suitable means for coupling the shafts. In the preferred embodiment a fluid powered cylinder 96 is utilized to slide a ring to engage the two shafts. Other means such as cables or levers may be utilized in place of the fluid cylinder without departing from the scope of the instant invention. This construction allows power from the prime mover 44 and the first transmission 46 to drive through the second transmission to the drive axle 50 of the truck for transport of the entire marking removal system in a conventional manner.

In the work mode, the input shaft 58 of the second transmission is uncoupled from the output shaft 60 via the fluid cylinder moving the engagement ring as described above. The second and/or third output shafts 62, 64 are coupled to the input shaft 58 via clutches 98 or other suitable means of engagement. Engagement of the second and/or third output shaft preferably engages the hydraulic pump output 66 to drive a first hydraulic pump 80, most preferably a variable volume pump. The second output shaft 62 is operably connected to the high pressure water pump 32 via belts pulleys. Alternatively, gears, chain drives or suitable combinations thereof may be utilized to connect the second output shaft to the high pressure water pump. In one embodiment, the third output shaft 64 is operably connected to a second hydraulic pump 78 (FIG. 1). The second hydraulic pump is fluidly connected to hydraulic motors 102 and 125 which are operably secured to the input shaft of vacuum pumps 26 and 124 respectively.

In an alternative embodiment, the third output shaft 64 is operably connected to the vacuum pump 26 via belts and pulleys as illustrated in FIG. 4. Alternatively, gears, chain drives or other suitable combinations thereof may be utilized to connect the third output shaft to the vacuum pump without departing from the scope of the instant invention. In this embodiment the second hydraulic pump 78 and hydraulic motor 102 are eliminated.

In the work mode the first hydraulic pump 80 and hydraulic motor 94 are utilized to form a mechanical-hydrostatic transmission, wherein fluid generated by the first pump 80 is delivered to the first hydraulic motor 94. The hydraulic motor is coupled to the hydraulic motor output shaft of the second transmission by suitable means such as a slip ring with internal splines 104, gears, clutches, chains or suitable combinations thereof. In the preferred embodiment a fluid powered cylinder 106 is utilized to slide the slip ring to engage the output shaft to the hydraulic motor. Other means such as cables or levers may be utilized in place of the fluid cylinder without departing from the scope of the invention. A joystick type control (not shown) is provided within the cab of the truck to allow an operator to infinitely control the speed of the truck within a predetermined range. In a most preferred embodiment the mechanical-hydrostatic transmission is constructed and arranged to propel the marking removal system from 0 to about 10 MPH.

The system described above is especially useful for marking removal on roadways or cleaning large surfaces, such as airport runways. The prime mover may be set at an optimum RPM for efficiency or power. The chassis mounted equipment is then powered from the prime mover thereby eliminating the need for additional prime movers for their operation. With the weight of the additional prime movers eliminated, the truck can carry additional water for extended operation without the need to refill the water tank 20. The mechanical-hydrostatic transmission allows the speed of the truck to be controlled for optimum marking removal. For example, the ground speed of the truck may be increased between marks being removed, such as dashed lines, without changing the speed of the prime mover and affecting the operation of the high pressure liquid pumps, the blast head, the abrading device or the vacuum pumps. In addition, the increased horsepower provided by the prime mover, since it does not have to propel the truck, allows for increased water pump size when compared to the prior art devices. The increased water pump size facilitates increased removal rates and/or the ability to operate multiple spray or blast heads as illustrated herein. The additional horsepower allows for the hydraulic pumps to operate the abrading devices without affecting the operational efficiency of the spray or blast heads. In addition to removing markings, the system is useful for tasks such as removal of accumulated rubber from airport runways, cleaning parking lots, cleaning factory floor and the like.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A self-propelled mobile marking removal system comprising:

a mobile vehicle assembly, said mobile vehicle assembly having a longitudinal axis along a length thereof, said mobile vehicle assembly including a chassis, a high pressure liquid pump in fluid connection with a liquid reservoir contained within said chassis, said high pressure liquid pump is further in fluid connection with a blast head, said blast head having at least one high pressure nozzle delivering liquid at high pressure to a marked surface, a waste removal hose fluidly coupled with said blast head and a sump for collection of liquid and debris, said blast head positionable along a left or a right side of said chassis, a mechanical abrasion means, said mechanical abrasion means positionable along a left or a right side of said chassis in front of said blast head, in alignment with said blast head along said longitudinal axis of said mobile vehicle, said mechanical abrasion means includes at least one cylindrical grinder, a housing substantially surrounding said at least one cylindrical rotatable grinder, a debris removal hose in fluid connection with said mechanical abrasion means and further in fluid connection with a container for collection of air and debris generated by said mechanical abrasion means, hydraulically actuated means to rotate said at least one cylindrical grinder, said hydraulically actuated means being in fluid connection with a hydraulic pump whereby said mechanical abrasion means substantially removes marking material protruding above said marked surface and said blast head substantially removes any marking material extending below said marked surface.

2. The self-propelled mobile marking removal system of claim 1 including a debris removal device in fluid connection with said mechanical abrasion means and also further in fluid connection with a container for collection of air and debris, said container in fluid connection with a vacuum pump, said container further including means to separate debris from air.

3. The self-propelled mobile marking removal system of claim 1 wherein liquid is pumped from said reservoir to said to said blast head and exits said at least one high pressure nozzle onto said marked surface thereby substantially removing marking material extending below said marked surface, said liquid and debris being collected by said blast head and transported to said sump, said sump containing a means to separate said liquid from said debris.

4. The self-propelled mobile marking removal system of claim 1 wherein an outlet from said container being in fluid connection with a vacuum pump and said container further including means to separate debris from air.

5. The self-propelled mobile marking removal system of claim 1 wherein said sump comprises a vacuum chamber, a high power vacuum pump connected to said vacuum chamber, said vacuum chamber having a rigid outside wall defining an interior, a wire mesh screen in said interior spaced inwardly of said rigid outside wall and forming an enclosure, said vacuum chamber having an inlet connected to said waste removal hose, said vacuum chamber having an outlet for the liquid, whereby liquid is pumped through a hose from said liquid reservoir and exits said blast head onto said marked surface thereby removing marking material therefrom, said liquid and marking material are transported through said waste removal hose by the vacuum generated in said vacuum chamber, the marking material is separated from said liquid.

6. The self-propelled mobile marking removal system of claim 5 wherein said liquid reservoir, said high pressure liquid pump, said sump, said vacuum pump, are mounted on a mobile chassis, said mobile chassis forms an integral part of a truck having a bed and a cab, said truck being self-propelled.

7. The self-propelled mobile marking removal system of claim 1 wherein said mechanical abrasion means includes two cylindrical grinders mounted parallel to each other, one cylindrical grinder being mounted in front of the other grinder in the direction of travel of the mobile marking removing system.

8. The self-propelled mobile marking removal system of claim 7 wherein said front mounted cylindrical grinder is slightly elevated from said marked surface with respect to the other the other grinder and still engaging said markings for removal thereof.

9. The self-propelled mobile marking removal system of claim 1 further including a second blast head mounted rearwardly of said blast head, said second blast head having at least one high pressure nozzle delivering liquid from said high pressure liquid pump onto a marked surface, a second water removal hose fluidly coupled with said second blast head and fluidly coupled at the other end thereof with said sump for the collection of liquid and debris.

10. The self-propelled mobile marking removal system of claim 1 wherein said blast head is attached to a wheeled chassis to maintain said blast head at a constant distance from said marked surface as said blast head is maneuvered over various terrains.

11. The self-propelled mobile marking removal system of claim 9 wherein said blast head and said second blast head are attached to a wheeled chassis to maintain said blast heads at a constant distance from said marked surface as said blast head is maneuvered over various terrains.

12. The self-propelled mobile marking removal system of claim 1 wherein said mechanical abrasion means includes means to position said at least one cylindrical grinder a constant distance from said marked surface as said mechanical abrasion means is maneuvered over various terrains.

13. The self-propelled marking removal system of claim 12 wherein said means to position said at least one cylindrical grinder comprises a wheeled chassis attached to said housing.

14. The self-propelled mobile marking removal system of claim 1 including a debris removal device in fluid connection with said mechanical abrasion means and also further in fluid connection with a container for collection of air and debris, said container in fluid connection with a vacuum pump, said container further including means to separate debris from air.

15. The self-propelled mobile marking removal system of claim 14 wherein said hydraulic pump and said vacuum pump are driven off a first side of a transmission.

16. The self-propelled mobile marking removal system of claim 15 wherein said high pressure liquid pump is driven off a second side of said transmission.

17. The self-propelled mobile marking removal system of claim 1 wherein said mechanical abrasion means and said blast head are mounted on said left side of said chassis and a second abrasion means and blast head are mounted on said right side of said chassis.

18. The self-propelled mobile marking removal system of claim 9 wherein said mechanical abrasion means, said blast head and said second blast head are mounted on said left side of said chassis and a second abrasion means, a third blast head and a fourth blast head are mounted on said right side of said chassis.

19. A self-propelled mobile marking removal system comprising:

a mobile vehicle assembly including a chassis, a high pressure liquid pump in fluid connection with a liquid reservoir contained within said chassis, said high pressure liquid pump is further in fluid connection with a blast head, said blast head having at least one high pressure nozzle for delivering liquid at high pressure to a marked surface, a waste removal hose fluidly coupled with said blast head and a sump for collection of liquid and debris, said blast head positionable along a left or a right side of said chassis, a mechanical abrasion means, said mechanical abrasion means positionable along a left or a right side of said chassis in front of said blast head, whereby said mechanical abrasion means is constructed and arranged to substantially remove marking material protruding above said marked surface and said blast head constructed and arranged to substantially remove any marking material extending below said marked surface.

said mechanical abrasion means includes at least one cylindrical grinder, a housing substantially surrounding said at least one cylindrical rotatable grinder including hydraulically actuated means to rotate said at least one cylindrical grinder, said hydraulically actuated means being in fluid connection with a hydraulic pump, a debris removal hose in fluid connection with said mechanical abrasion means and further in fluid connection with a container for collection of air and debris generated by said mechanical abrasion means.

20. The self-propelled mobile marking removal system of claim 19 including a debris removal device in fluid connection with said mechanical abrasion means and also further in fluid connection with a container for collection of air and debris, said container in fluid connection with a vacuum pump, said container further including means to separate debris from air.

* * * * *